US008127942B2

(12) United States Patent
Meshkinfam

(10) Patent No.: US 8,127,942 B2
(45) Date of Patent: Mar. 6, 2012

(54) SANITIZING RACK

(76) Inventor: Behrouz Meshkinfam, Woodland Hills, CA (US)

( * ) Notice: Subject to any disclaimer, the term of this patent is extended or adjusted under 35 U.S.C. 154(b) by 386 days.

(21) Appl. No.: 12/430,452

(22) Filed: Apr. 27, 2009

(65) Prior Publication Data

US 2010/0012601 A1 Jan. 21, 2010

Related U.S. Application Data

(60) Provisional application No. 61/082,065, filed on Jul. 18, 2008.

(51) Int. Cl.
*A47G 19/08* (2006.01)

(52) U.S. Cl. ..... 211/41.3

(58) Field of Classification Search ..... 211/41.3, 211/85.25, 41.1; D32/3, 55; 220/487, 488, 220/572
See application file for complete search history.

(56) References Cited

U.S. PATENT DOCUMENTS

| | | | | | |
|---|---|---|---|---|---|
| 819,112 | A * | 5/1906 | Wylie | 220/572 |
| 1,406,773 | A * | 2/1922 | Stoffel | 211/41.3 |
| 1,692,003 | A * | 11/1928 | Thayer | 220/572 |
| 1,789,232 | A * | 1/1931 | Hertz | 211/41.3 |
| 4,531,641 | A * | 7/1985 | Archambault | 211/41.3 |
| 4,756,582 | A * | 7/1988 | Heien | 312/229 |
| 5,119,943 | A * | 6/1992 | Hoang | 211/41.3 |
| 5,485,927 | A * | 1/1996 | Hubbard | 211/41.3 |
| 5,704,492 | A * | 1/1998 | Bartko | 211/41.3 |
| 6,021,906 | A * | 2/2000 | Heien | 211/41.3 |
| 6,119,736 | A * | 9/2000 | Huang et al. | 141/88 |
| 6,367,636 | B1 * | 4/2002 | Walker | 211/41.3 |
| 6,491,170 | B1 * | 12/2002 | Madela | 211/41.3 |
| 6,763,959 | B2 * | 7/2004 | Tedder | 211/188 |
| 7,325,695 | B2 * | 2/2008 | Yang et al. | 211/41.3 |
| D599,068 | S * | 8/2009 | Yang et al. | D32/55 |
| 2010/0012601 | A1 * | 1/2010 | Meshkinfam | 211/41.3 |
| 2010/0059460 | A1 * | 3/2010 | Mulaw | 211/41.3 |

* cited by examiner

*Primary Examiner* — Sarah Purol
(74) *Attorney, Agent, or Firm* — Century IP Group, Inc.; F. Jason Far-hadian, Esq.

(57) ABSTRACT

An apparatus for draining liquid from wet items is provided. The apparatus comprises opposing sidewalls, a rear wall, a front wall; a sloped floor positioned at an inclined angle between the two opposing sidewalls such that surface of the sloped floor meets the rear wall at a first position and the front wall at a second position, such that the first position is lower in altitude relative to the second position, wherein an opening formed in the apparatus allows for wet items to be placed in between the sidewalls on the sloped floor; one or more receiver partitions formed on the sloped floor to receive the wet items; and a gutter running along at least a portion of the sloped floor approximately at the first position where the sloped floor meets the rear wall, wherein the gutter is configured to collect liquid drained from the wet items.

6 Claims, 5 Drawing Sheets

SANITIZING RACK

CROSS-REFERENCE TO RELATED APPLICATION

Pursuant to 35 USC 119, this Application claims the right of priority to Provisional Patent Application Ser. No. 61,082,065 filed on Jul. 18, 2008. The content of said application is incorporated herein by reference in entirety.

COPYRIGHT & TRADEMARK NOTICES

A portion of the disclosure of this patent document contains material which is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is for providing an enabling disclosure by way of example and shall not be construed to limit the scope of this disclosure to material associated with such marks.

TECHNICAL FIELD

The present disclosure relates generally to a drying rack which provides for convenient and sanitary drying of washed objects.

BACKGROUND

In typical household kitchens, it is common to use a dish rack adjacent to the kitchen sink for the collection of wet dishes or other items after the manual washing of the dishes in the sink. Typically, the dishes are rinsed and placed in the rack to air dry. The bottom of the rack is usually slotted to allow water to be drained off the dishes.

A mat or tray made of rubber or plastic is generally used in conjunction with the rack for the purpose of collecting the water drained off the dishes. While such products are accepted in the common trade, several shortcomings prevent existing rack and tray sets from satisfying some basic consumer needs.

For example, the draining trays under the currently used dish racks are very shallow, such that the discharge from washed dishes easily overflows over the edges and spills over onto the counter and generally under the tray. Unfortunately, the water accumulating under the rack and the tray which often contains leftover food particles can result in rot or mildew and create bacteria or other unsanitary conditions.

It would also be desirable for all the water drained from the dishes to be automatically and directly deposited into an adjacent sink, so that the dishes and the countertop area underneath the rack remain fully dry, avoiding any possible health hazards.

SUMMARY

The present disclosure is directed to an apparatus for the convenient and sanitary drying of dishes or other items.

For purposes of summarizing, certain aspects, advantages, and novel features of the disclosure have been described herein. It is to be understood that not all such advantages may be achieved in accordance with any one particular embodiment of the disclosure. Thus, the disclosure may be embodied or carried out in a manner that achieves or optimizes one advantage or group of advantages without achieving all advantages as may be taught or suggested herein.

An apparatus for draining liquid from wet items is provided. The apparatus comprises two opposing sidewalls, a rear wall, a front wall; and a sloped floor positioned at an inclined angle between the two opposing sidewalls. The surface of the sloped floor meets the rear wall at a first position and the front wall at a second position, such that the first position is lower in altitude relative to the second position.

An opening allows for wet items to be placed in between the sidewalls on the sloped floor. One or more receiver partitions may be formed on the sloped floor to receive and hold the wet items. A gutter may be formed along at least a portion of the sloped floor. In one embodiment, the gutter is approximately placed at a first position where the sloped floor meets the rear wall. The gutter, in one implementation, is configured to collect liquid drained from the wet items.

In one embodiment, the gutter may be sloped to allow the collected liquid in the gutter to drain outward toward one or more exit routes. A spout may be connected at one end of the gutter through which the collected liquid may drain out of the gutter. In one embodiment, the collected liquid may further be drained from the spout into an adjacent sink by way of a hose extending from an outlet of the spout into the sink. Other embodiments may comprise a hose which is removable.

Another embodiment may comprise a first compartment positioned inside the two opposing sidewalls for receiving elongated objects in an upright position. The first component may be detachable from the apparatus. In other embodiments, there may be a removable cap for each of the one or more spouts, which may be used to close the one or more spouts when the one or more spouts are not in use.

Another embodiment comprises two opposing sidewalls, a rear wall, a front wall; a sloped floor positioned at an inclined angle between the two opposing sidewalls such that surface of the sloped floor meets the rear wall at a first position and the front wall at a second position, such that the first position is lower in altitude relative to the second position.

An opening allows for wet items to be placed in between the sidewalls on the sloped floor. A removable receiver portion may be included with one or more partitions which may be placed within the two opposing sidewalls for receiving washed items. A gutter running along the rear wall juxtaposed on a lower end of the sloped floor may be included for collecting liquid drained from the washed items. One or more spouts are connected at an end of the gutter through which the collected liquid may drain out of the gutter.

One or more of the above-disclosed embodiments in addition to certain alternatives are provided in further detail below with reference to the attached figures. The disclosure is not, however, limited to any particular embodiment disclosed.

BRIEF DESCRIPTION OF THE DRAWINGS

Embodiments of the present disclosure are understood by referring to the figures in the attached drawings, as provided below.

Features, elements, and aspects of this disclosure that are referenced by the same numerals in different figures represent the same, equivalent, or similar features, elements, or aspects, in accordance with one or more embodiments.

DETAILED DESCRIPTION OF EXAMPLE EMBODIMENTS

Figure 1:
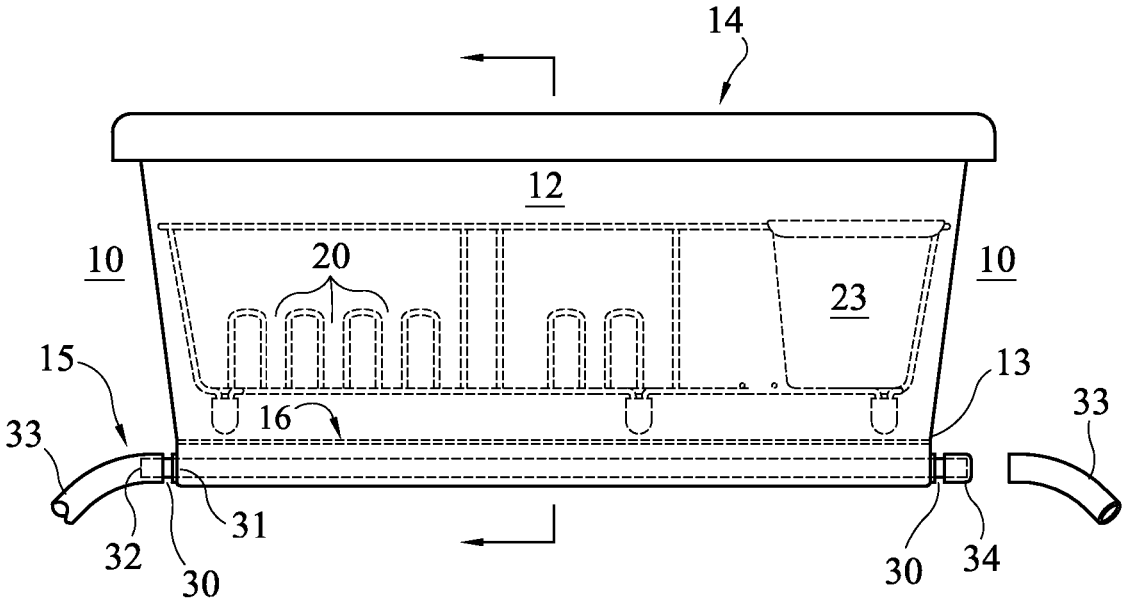
FIG. 1 is a side view of an apparatus for drying items, in accordance with one embodiment.

The present disclosure is directed to an apparatus for the convenient and sanitary drying of dishes, utensils and other washable items.

In the following, numerous specific details are set forth to provide a thorough description of various embodiments of the presently disclosed apparatus. Certain embodiments of the disclosed apparatus may be practiced without these specific details or with some variations in detail. In some instances, certain features are described in less detail so as not to obscure other aspects of the disclosure. The level of detail associated with each of the elements or features should not be construed to qualify the novelty or importance of one feature over the others.

Referring to FIGS. 1 through 4, in one embodiment, an apparatus for draining liquid from wet items is shown. The apparatus comprises two opposing sidewalls 10, a rear wall 12, a front wall 11; and a sloped floor 13 positioned at an inclined angle between the two opposing sidewalls 10. The surface of the sloped floor 13 meets the rear wall 12 at a first position and the front wall 11 at a second position.

In one embodiment, the first floor area is positioned lower in height relative to the second floor area so that a liquid poured unto the first floor area is drained towards the second floor area. An opening 14 is configured to allow for wet items 22 to be placed in between the sidewalls 10 on the sloped floor 13. One or more receiver partitions 20 are formed on the sloped floor 13 to receive and hold the wet items 22. A gutter 16 may be formed along at least a portion of the sloped floor 13. In one embodiment, the gutter 16 is placed approximately at the first position where the sloped floor 13 meets the rear wall 12. In an alternate embodiment, the gutter 16 may be placed central to the sloped floor or at any other portion of the sloped floor and configured to collect liquid drained from the wet items 22 placed in the apparatus.

Figure 3:
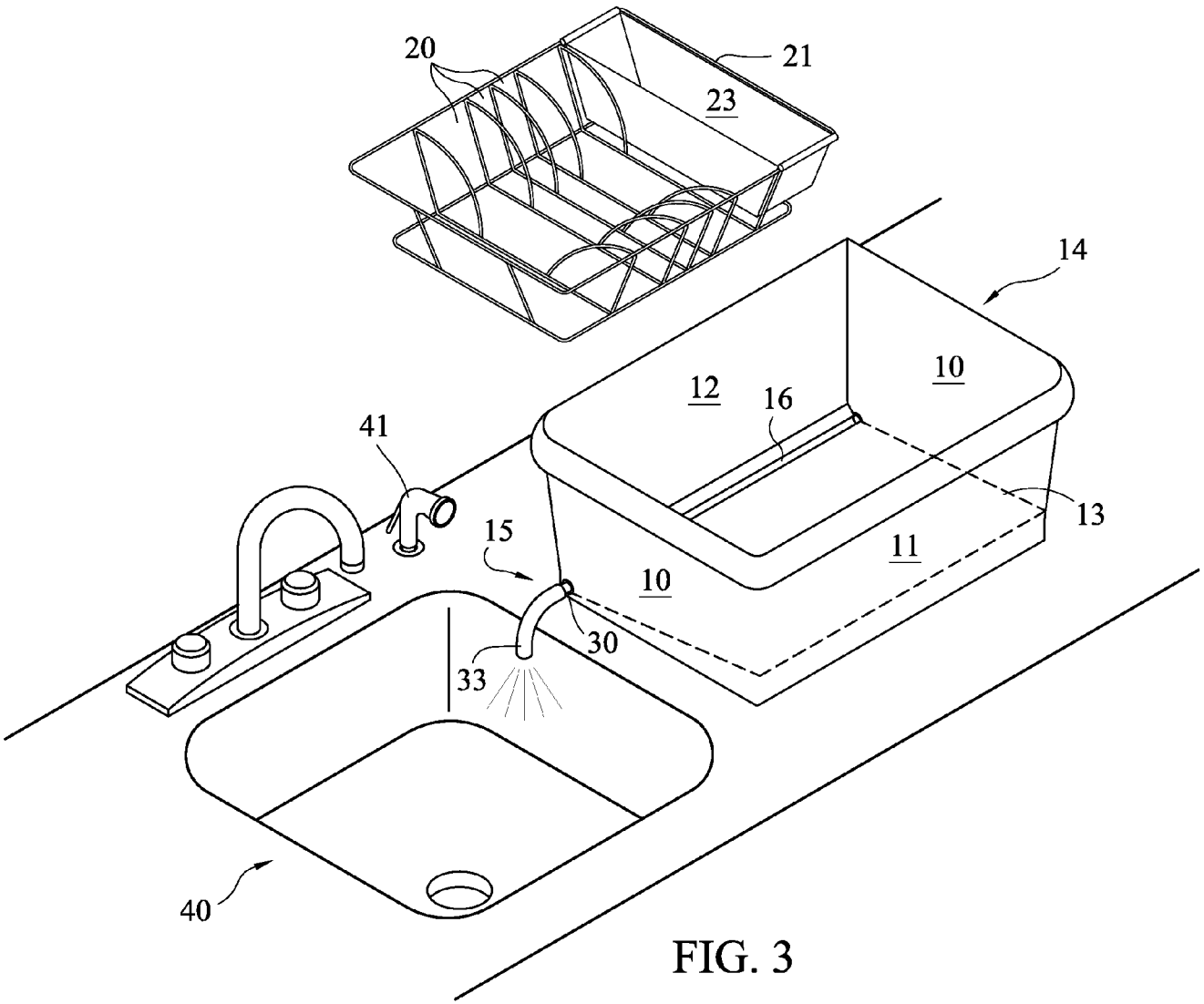
FIG. 3 is an exploded view of the various components of the apparatus in accordance with one embodiment and shown adjacent to an exemplary sink.
Figure 4:
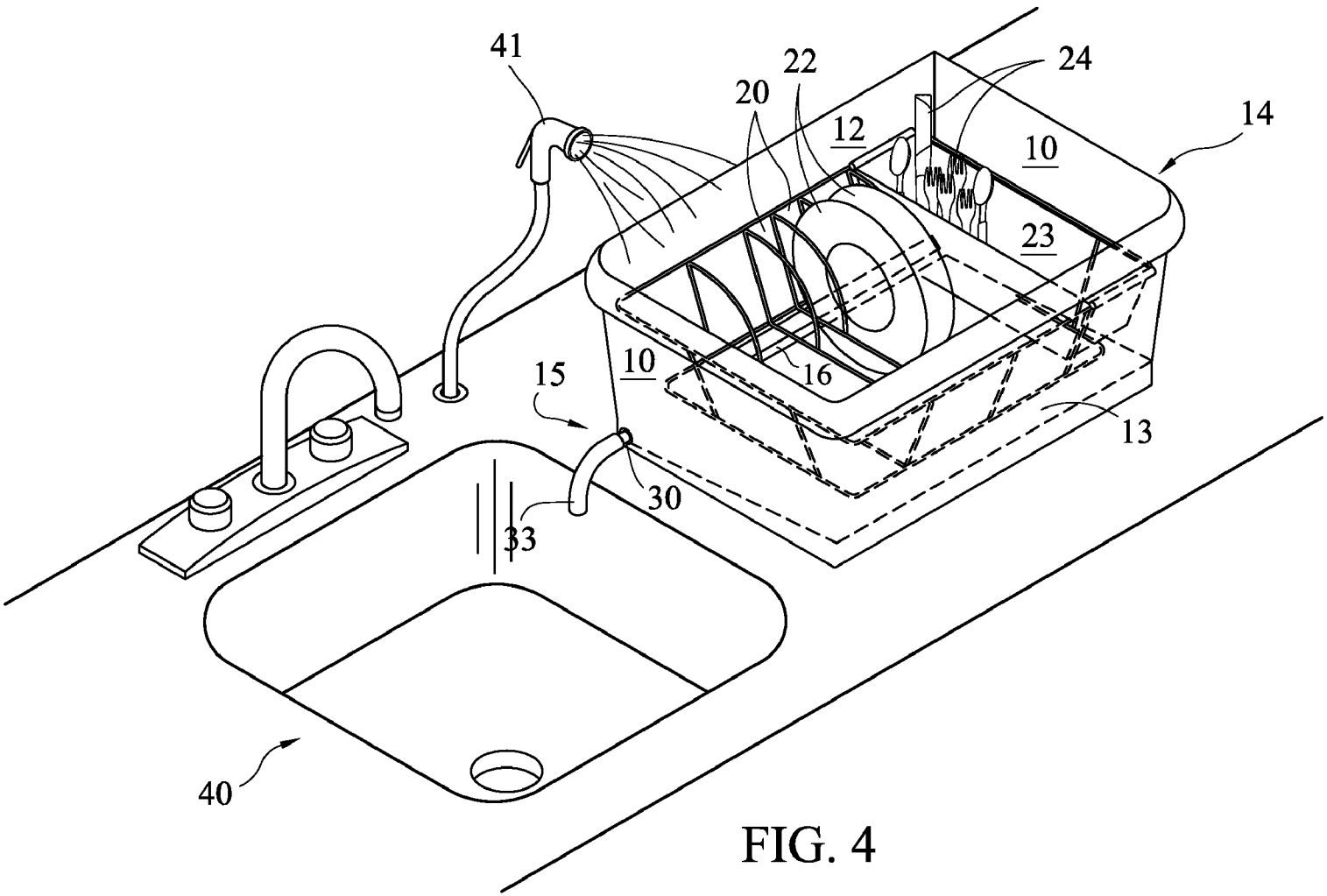
FIG. 4 is a perspective view of the apparatus of FIG. 1, in accordance with one embodiment.

Referring to FIGS. 3 and 4, in one embodiment, the apparatus may further comprise a first compartment 23 positioned inside the two opposing sidewalls 10 for receiving elongated objects 24 (e.g., utensils) in desirably an upright manner. At least one spout 30 may be formed at the floor 13 level through which water or other liquid may drain. The spout 30 is desirably formed at an end of a gutter 16 which runs along the rear wall 12. Gutter 16 is near the bottom area 15 of the sloped floor 13, where the sloped floor 13 meets the rear wall 12. The spout 30 has an inlet 31 and an outlet 32 such that liquid discharge can empty from gutter 16 into an adjacent sink 40, desirably, by way of a hose 33 extending from the outlet of the spout 30 into the sink 40.

Other embodiments may comprise a sloped floor that is, for example, cone-shaped or V-shaped or partially spherical in shape (not shown in the exemplary figures) with a gutter 16 positioned along one or more of the lower or lowest points of the sloped floor. Certain embodiments may comprise multiple drainage spouts 30 connected to different sections of the gutter 16. Advantageously, due to the availability of different drainage spouts 30, the apparatus can be easily placed at either side of the sink 40, and may be moved or positioned in different locations and distances from the sink 40 obviating the associated disadvantage with currently used dish racks which require the dish rack to be placed within the immediate vicinity of the kitchen sink 40.

Since the kitchen counter tops can be designed in a variety of ways, having the option for multiple spouts 30 connected to the gutter 16 allows the apparatus to adapt to virtually any counter top design. The availability of multiple spouts 30, for example, enables a user to place the apparatus in multiple positions about a sink 40, and lends itself to a higher level of versatility for the apparatus and its positioning around the sink 40.

Additionally, if more counter area is needed for a brief period on a particular side of the sink 40, the apparatus can easily be moved to a different area and still retain functionality. For example, the drainage spouts 30 in one implementation may be equipped with one or more plugs or spout caps 34 so that a user can prevent the drainage of liquid from the apparatus temporarily (i.e., when the apparatus is not within sufficient proximity of the sink 40).

Accordingly, a spout cap 34 may be used to close-off a spout 30. Such feature advantageously increases the adaptability of the apparatus by enabling a user to close off unused spouts 30 and position the apparatus in an increased variety of locations.

Figure 2:
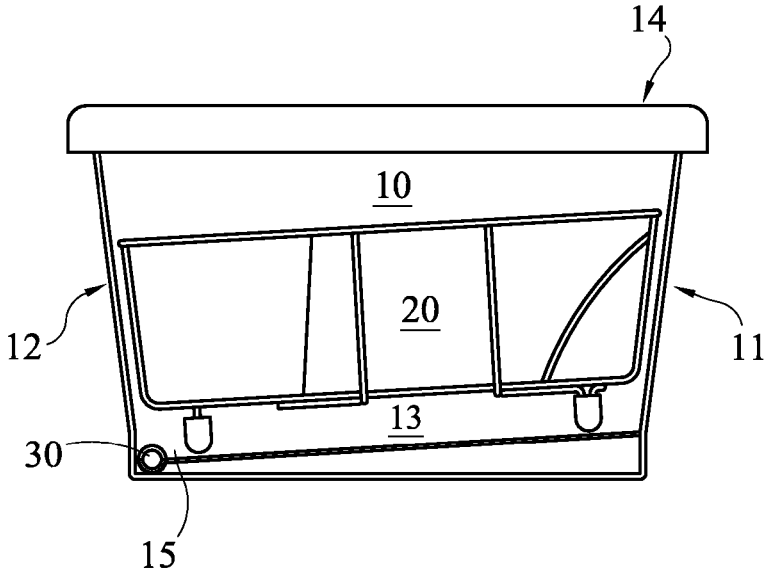
FIG. 2 is a cross-sectional view of the apparatus of FIG. 1, along cross-section A-A in accordance with one embodiment.

Referring to FIG. 2, as mentioned earlier, the floor 13 of the apparatus may be tapered, sloped or positioned at an angle, such that the liquid discharge and any solid particles on it flow to the lower area 15 of the sloped floor 13 of the apparatus and are drained efficiently into an adjacent sink 40 through the spouts 30. The spouts 30 may each include a filter (not shown) that helps remove the solid particles from the liquid discharge. The filters may be designed to be removable or replaceable depending on implementation.

Referring to FIG. 3, one embodiment of the apparatus may comprise a removable receiver portion 21. This allows for convenient cleaning of the apparatus and makes the apparatus more versatile. Desirably, in one embodiment, one or more of the sidewalls 10, front wall 11 and rear wall 12 may be of sufficient height such that a person can place washed items 22 which have not been rinsed into the apparatus and use an adjacent water supply 41 to rinse the washed items 22 directly in the apparatus without splashing water onto the surrounding area or counter top, as shown in FIG. 4.

That is, one or more embodiments can be utilized as an external sink when needed, for example, when the main sink 40 is full. Walls 10, 11 and 12 are desirably high enough to prevent liquid from overflowing over the edges of the walls while the apparatus is being utilized for washing the items inside the apparatus. This feature avoids the possibility of the water overflowing and becoming trapped beneath the apparatus and eliminates or minimizes unsanitary conditions that may result there from.

In addition, the higher walls are functional as a safety feature, ensuring that clothing or other material or items placed inside the apparatus are not caught in users' clothing or reach, limiting creation of a dangerous condition or the possibility for the apparatus being dragged across the surface, or ultimately falling off the counter top.

Figure 5:
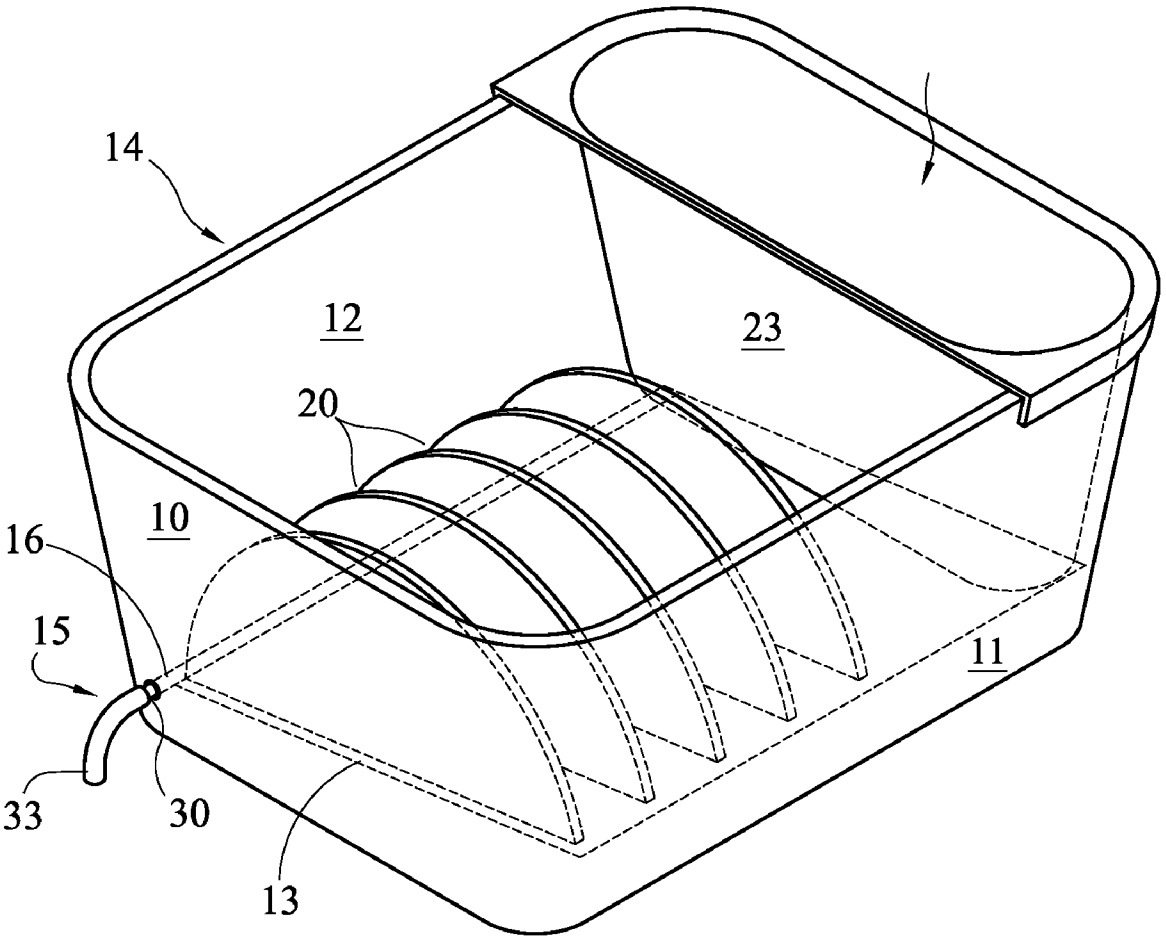
FIG. 5 is a perspective view of the apparatus, in accordance with another embodiment.
Figure 6:
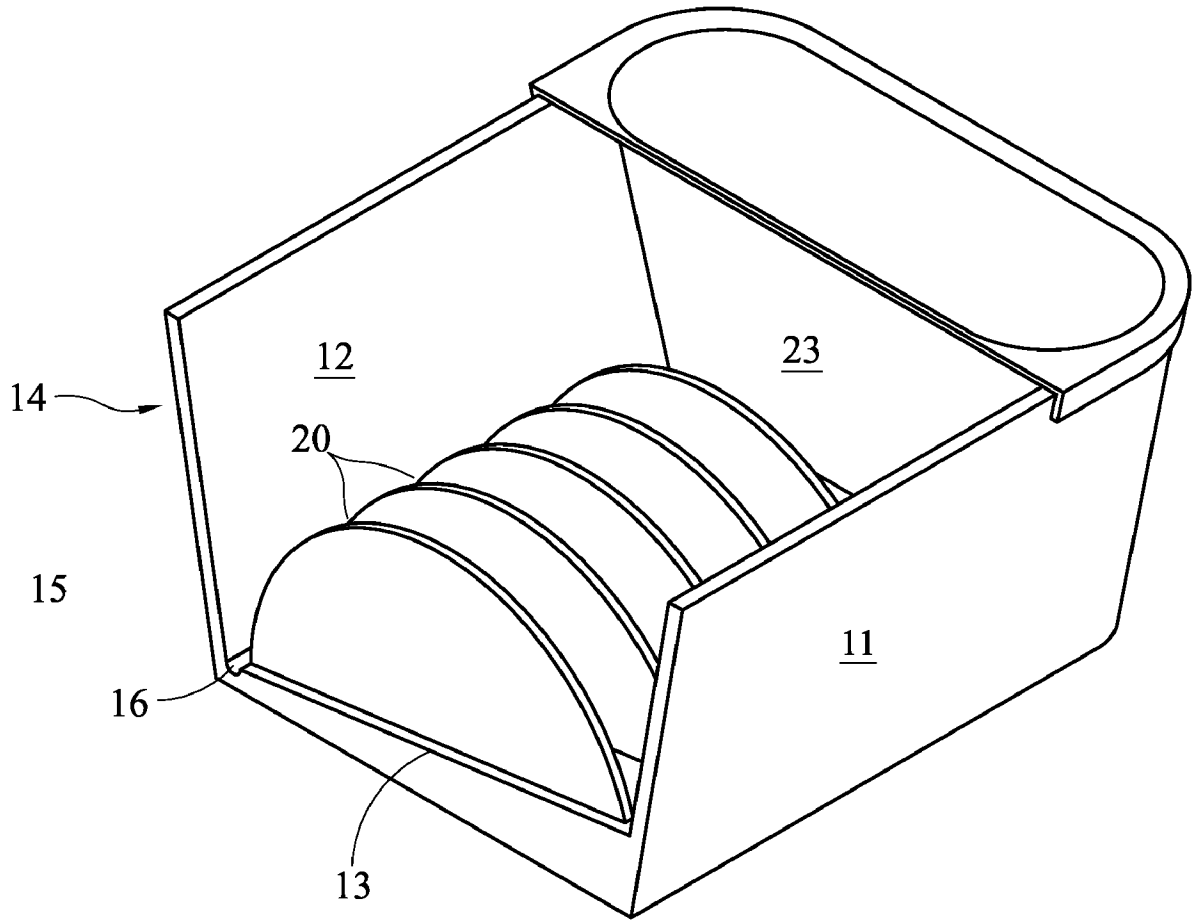
FIG. 6 is a perspective cross-sectional view of the apparatus of FIG. 5, showing the sloped floor in accordance with one embodiment.

Referring to FIGS. 5 and 6, one embodiment of the disclosed apparatus may comprise one or more receiver partitions 20 formed on the sloped floor 13 to receive and hold the washed items 22. The embodiments illustrated in FIGS. 5 and 6 may be monolithic in design in comparison to embodiments illustrated in FIGS. 1 through 4, which are comprised of multiple components. In some embodiments, the apparatus as shown in FIG. 5 may be monolithic in design, but the component 20 may be detachable, such that it can be easily removed from the other portion of the apparatus.

It should be understood that the disclosed apparatus can be practiced with modification and alteration within the spirit and scope of the appended claims. The description is not intended to be exhaustive or to limit the disclosed apparatus to the precise form disclosed. These and various other adaptations and combinations of the embodiments disclosed are within the scope of the disclosed apparatus and are further defined by the claims and their full scope of equivalents.

The invention claimed is:

1. An apparatus for draining liquid from wet items, the apparatus comprising:

two opposing sidewalls, a rear wall, a front wall;

a sloped floor positioned at an inclined angle between the two opposing sidewalls such that surface of the sloped floor meets the rear wall at a first position and the sloped floor meets the front wall at a second position, such that the first position is lower in altitude relative to the second position, wherein an opening formed in the apparatus allows for wet items to be placed in between the sidewalls on the sloped floor;

one or more receiver partitions formed on the sloped floor to receive and hold the wet items; and a gutter running along an edge where the rear wall meets the sloped floor, the gutter running along a substantial portion of the sloped floor at the first position wherein the gutter is substantially tangent to the rear wall at an internal edge where the sloped floor meets the rear wall, wherein the gutter is configured to collect liquid drained from the wet items, wherein the gutter is configured to allow the collected liquid in the gutter to drain outward toward at least a first exit route and a second exit route, wherein a first spout is connectable to a first end of the gutter, adjacent to a first sidewall, that forms the first exit route and a second spout is connectable to a second end of the gutter, adjacent to a second sidewall, that forms the second exit route, wherein the second end of the gutter is located diametrically opposed to the first end of the gutter, such that the collected liquid drains out of the gutter through the first spout when the second spout is plugged and the collected liquid drains out of the gutter through the second spout when the first spout is plugged;

wherein the collected liquid is drained from the first spout or the second spout into an adjacent sink by way of a first hose or a second hose, respectively, extending from outlets of the first spout or the second spout into the sink, wherein in a first placement position the rear wall is positioned away from the user, the front wall is positioned towards the user and the first sidewall is positioned next to a first side of the sink such that the first hose extends into the sink from the first spout without interfering with the user's ability to use the sink due to the location of the first spout being towards the rear wall in the first placement position, wherein in a second placement position the rear wall is positioned away from the user, the front wall is positioned towards the user and the second sidewall is positioned next to a second side of the sink, wherein the second side of the sink is diametrically opposed to the first side of the sink, such that the second hose extends into the sink from the second spout without interfering with the user's ability to use the sink due to the location of the second spout being towards the rear wall in the second placement position, and wherein in the first placement position the second spout is plugged and in the second placement position the first spout is plugged.

2. The apparatus of claim 1, wherein the first and second hoses are removable and wherein the first hose and the second hose are sufficiently long to allow the collected liquid to drain into the sink without dripping or jetting back toward an under portion of the sloped floor.

3. The apparatus of claim 1, further comprising a first compartment positioned inside the two opposing sidewalls for receiving elongated objects in an upright position.

4. The apparatus of claim 3, wherein the first compartment is detachable from the apparatus so that in the first placement position the first compartment is located adjacent to the second sidewall and in the second placement position the first compartment is located adjacent to the first sidewall.

5. The apparatus of claim 1, wherein there is a removable cap for the first and second spouts, which may be used to plug one of the first or second spouts when one of the spouts is not in use.

6. The apparatus of claim 1, wherein the gutter is sloped to allow the collected liquid in the gutter to drain outward toward one or more exit routes.

* * * * *